US006059607A

United States Patent [19]

Wilson

[11] Patent Number: 6,059,607

[45] Date of Patent: May 9, 2000

[54] SHIELDED ELECTRICAL CONNECTOR

[75] Inventor: Albert H. Wilson, Los Angeles, Calif.

[73] Assignee: Molex Incorporated, Lisle, Ill.

[21] Appl. No.: 09/042,938

[22] Filed: Mar. 17, 1998

[51] Int. Cl.[7] ..... H01R 9/03

[52] U.S. Cl. ..... 439/610; 439/607

[58] Field of Search ..... 439/607, 608, 439/609, 610, 906, 904, 701, 444

[56] References Cited

U.S. PATENT DOCUMENTS

| | | | |
|---|---|---|---|
| 3,056,942 | 10/1962 | Carbaugh et al. . | |
| 4,457,576 | 7/1984 | Cosmos et al. . | |
| 5,158,481 | 10/1992 | Frantz | 439/607 |
| 5,823,825 | 10/1998 | Murphy | 439/610 |

FOREIGN PATENT DOCUMENTS

608863 A2 3/1994 European Pat. Off. ..... H01R 13/436

*Primary Examiner*—Lincoln Donovan
*Assistant Examiner*—Eugene Byrd
*Attorney, Agent, or Firm*—James C. Paschall

[57] ABSTRACT

An electrical connector includes an insulative housing having a forward mating end, a rear terminating end and a plurality of terminal-receiving passages extending between the ends. A conductive front shell is disposed about a substantial portion of at least the forward mating end of the housing. A pair of conductive rear backshells are disposed about a substantial portion of at least the rear terminating end of the housing. The backshells are swivelably mounted to the front shell on front-to-rear axes for movement between open and closed positions.

22 Claims, 5 Drawing Sheets

SHIELDED ELECTRICAL CONNECTOR

FIELD OF THE INVENTION

This invention generally relates to the art of electrical connectors and, particularly, to a shielded electrical connector having an improved backshell assembly.

BACKGROUND OF THE INVENTION

In many electrical connector applications, external electrical "noise" may penetrate into the signal lines extending through the electrical connector by electromagnetic induction. Conversely, electrical noise may radiate out of the connector from the signal lines to other electrical equipment by electromagnetic radiation. Such "noise" is referred to as electromagnetic interference (EMI). In use, with the ever-increasing miniaturization of electronic components accompanied by increased density of circuit arrangements, electronic devices often are used in closely spaced relationships which can cause problems due to the EMI and/or radio frequency (RF) of one electronic device or connector absorbed by a neighboring device.

In order to eliminate or significantly reduce the effects of EMI and RF, electrical connectors often are provided with a shield which surrounds the electrical connector at least about the signal line termination area thereof. A typical shield is a metal shell which often is stamped and formed of sheet metal material. The metal shell provides a covering about the outer periphery of an insulative housing in which a plurality of terminals are mounted. For instance, the metal shell may have a front opening to expose a front mating end of the housing and a rear opening from which conductors extend.

Quite often, metal shells or shields are fabricated of a plurality of parts which are relatively movable from an open condition allowing assembly of the connector housing, terminals and/or conductors therewith in and a closed condition encasing the components and providing a protective EMI/RF shield therefor.

There are a number of continuing problems associated with metal shells or shields for electrical connectors, particularly when the shells are fabricated of a plurality of parts. For instance, the parts often are difficult to manipulate during assembly and often are a detriment to an efficient assembly operation. In addition, multi-part shells often create EMI and/or RFI leakage paths between the parts. The present invention is directed to satisfying a need for an improved shell for shielding an electrical connector and concentrating on the problems identified above.

SUMMARY OF THE INVENTION

An object, therefore, of the invention is to provide an electrical connector with a new and improved conductive shell assembly for an electrical connector.

In the exemplary embodiment of the invention, an electrical connector is disclosed with an insulative housing having a forward mating end, a rear terminating end and a plurality of terminal-receiving passages therethrough. A plurality of terminals are received in the passages. A conductive front shell is disposed about a substantial portion of at least the forward mating end of the housing. A pair of conductive rear backshells are disposed about a substantial portion of at least the rear terminating end of the housing. The backshells are swivelably mounted to the shell on front-to-rear axes for movement between open and closed positions.

As disclosed herein, the mating end of the housing is formed by a forwardly projecting profiled portion. The front shell includes a forwardly projecting profiled shroud about the profiled portion of the housing. The pair of backshells have identical configurations, and the backshells as well as the front shell are fabricated of stamped and formed sheet metal material.

The conductive front shell includes a plate extending transversely of the front-to-rear axes and to which the backshells are swivelably mounted. The backshells include flanges juxtaposed against the back side of the plate on the axes. The flanges include apertures aligned with complementary apertures in the plate for receiving appropriate fastening means therethrough. A pair of guide bushings project forwardly of the plate coincident with the apertures for guiding the fastening means therethrough. The guide bushings extend through the apertures in both the plate and the flanges of the backshells, and the bushings have outwardly flared rear ends to fasten the backshells to the shell and to define the swivel axes for the backshells. Alternate methods of fastening the backshells to the front shell include utilizing a screw inside the bushing secured through the aperture with a nut or a threaded protrusion extending from the guide bushing through the aperture and secured with a nut.

Another feature of the invention is the provision of strain relief sections at the rear ends of the backshells for encapsulating appropriate conductors terminated to the terminals in the housing. More particularly, the strain relief section of at least one of the backshells includes a crimp finger having opposite outside edges that converge toward a distal end of the finger. The strain relief section of at least the other of the backshells includes a slot having opposed inside edges that diverge toward a mouth of the slot. The finger and the slot are complementarily dimensioned such that when the finger is crimped into the slot, the outside edges of the finger will engage the inside edges of the slot at a given crimping point and, thereby, completely encapsulate the conductors without any or with minimal voids between the finger and the slot. As disclosed herein, a plurality of these complementary interengaging fingers and slots are provided between the backshells.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2:
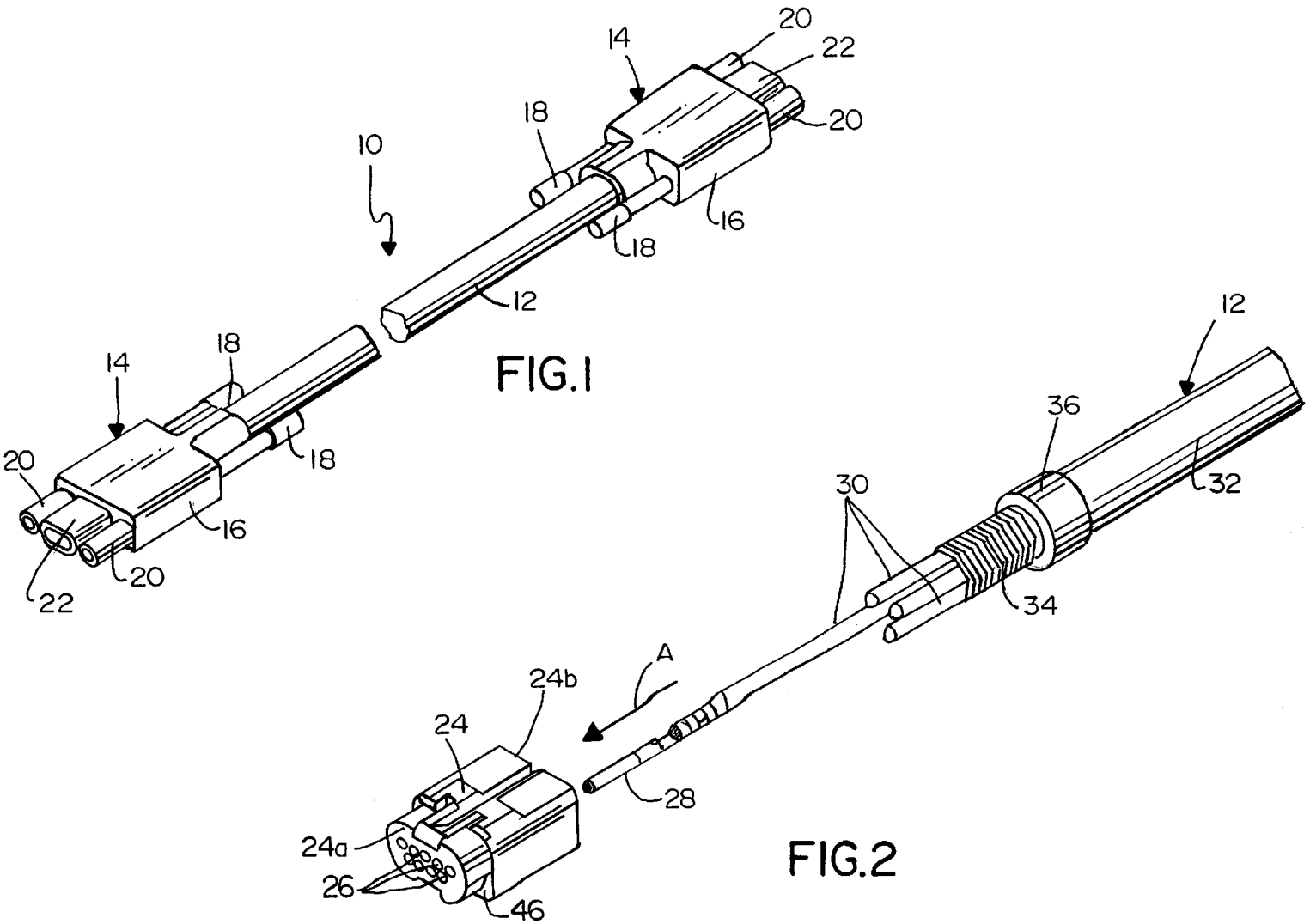
FIG. 1 is a perspective view of a cable assembly having electrical connectors at opposite ends thereof, the connectors being one type with which the invention is applicable.
FIG. 2 is an exploded perspective view of the housing/terminal/conductor assembly within one of the connectors.

Referring to the drawings in greater detail, and first to FIG. 1, an electrical cable assembly or harness, generally designated 10, is shown to include an electrical cable 12 having a pair of electrical connectors, generally designated 14, terminated to opposite ends of the cable. Each connector includes an outer insulating boot 16 which may be an overmolded plastic component, for instance. A pair of jack screws 18 extend on front-to-rear axes through each connector and into a pair of forwardly projecting bushings 20 at the front mating end of the connector for connectors required to have threaded positive retention. A shroud 22 of a shielding shell assembly (described hereinafter) also projects forwardly from the mating end of each connector.

Referring to FIG. 2 in conjunction with FIG. 1, each connector 14 includes an insulative housing 24 having a forward mating end 24*a*, a rear terminating end 24*b* and a plurality of terminal-receiving passages 26 therethrough. A plurality of terminals 28 are insertable into the passages in the direction of arrow "A".

Still referring to FIG. 2, cable 12 includes a plurality of electrical wires 30 having conductors terminated to terminals 28, as by crimping. The cable has an outer dielectric sheath 32, with a shielding braid 34 between the sheath and wires 30. In assembly, the cable is inserted through a crimp ring 36, and braid 34 will be folded back over the crimp ring, whereby the ring prevents any crimping forces from crushing the interior electrical wires and their respective dielectrics.

Figure 3:
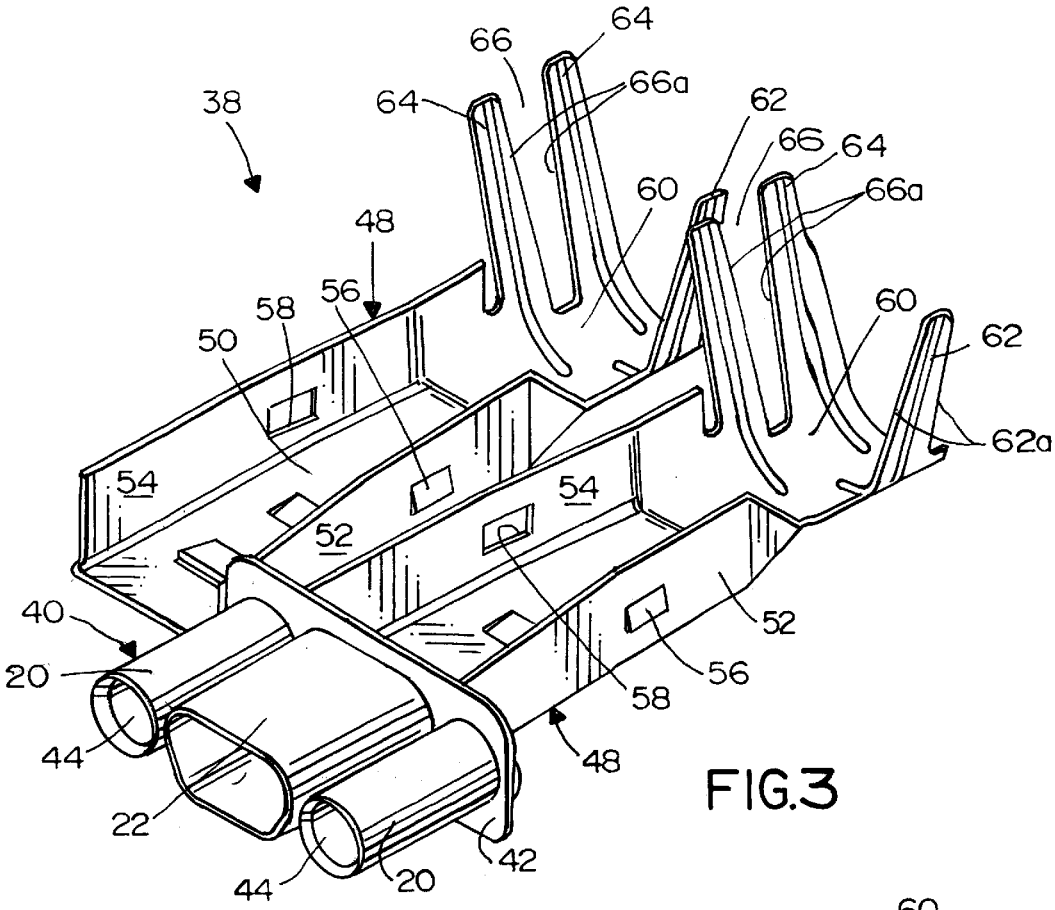
FIG. 3 is a front perspective view of the shell assembly of the invention, with the backshells in open condition.

Referring to FIG. 3, the invention is embodied in a shell assembly, generally designated 38, which includes a front shell, generally designated 40. The front shell includes a transverse plate 42 as well as bushings 20 and shroud 22. The bushings have through holes 44 in registry with the front ends of jack screws 18 (FIG. 1). Shroud 22 receives forward mating end 24*a* (FIG. 2) of housing 24 when the housing is inserted into the shell assembly from the rear of plate 42. It can be seen in FIG. 2 that forward mating end 24*a* of the housing is formed by a forwardly projecting profiled portion of the housing, such as in a known "D" configuration. Correspondingly, shroud 22 of shell assembly 38 has a complementary profile for substantially surrounding the profiled forward mating end of the housing, as a shoulder 46 (FIG. 2) abuts against the rear of plate 42 during assembly.

Still referring to FIG. 3, shell assembly 38 includes a pair of conductive rear backshells, generally designated 48, which are stamped and formed of sheet metal material and are identical in configuration. Each backshell is generally U-shaped in cross-section and includes a base wall 50 and a pair of side walls 52 and 54. Each side wall 52 has an angled latch boss 56 stamped and formed therefrom, for latchingly engaging within a latch aperture 58 stamped in the other side wall 54.

Each backshell 48 includes a strain relief section 60 at the rear thereof for encapsulating and crimping onto crimp ring 36 (FIG. 2) about cable 12. With backshells 48 being of identical configuration, each strain relief section 60 includes a first crimp finger 62 on one side thereof and a pair of second crimp fingers 64 on the opposite side thereof. All of the crimp fingers are tapered such that opposite edges 62*a* of each crimp finger 62 converge toward a distal end of the finger. With second crimp fingers 64 also being tapered, a slot 66 is defined therebetween, with the slot having opposed inside edges 66*a* that diverge toward the open mouth of the slot at the distal ends of fingers 64. As will be seen hereinafter, finger 62 and slot 66 of each strain relief section 60 are complementarily dimensioned such that when finger 62 is crimped into its respective slot 66, outside edges 62*a* of the finger will engage inside edges 66*a* of the slot 66 at a given crimping point and, thereby, completely encapsulate the conductors without the presence of any voids or with minimal voids between the finger and the slot.

Figure 4:
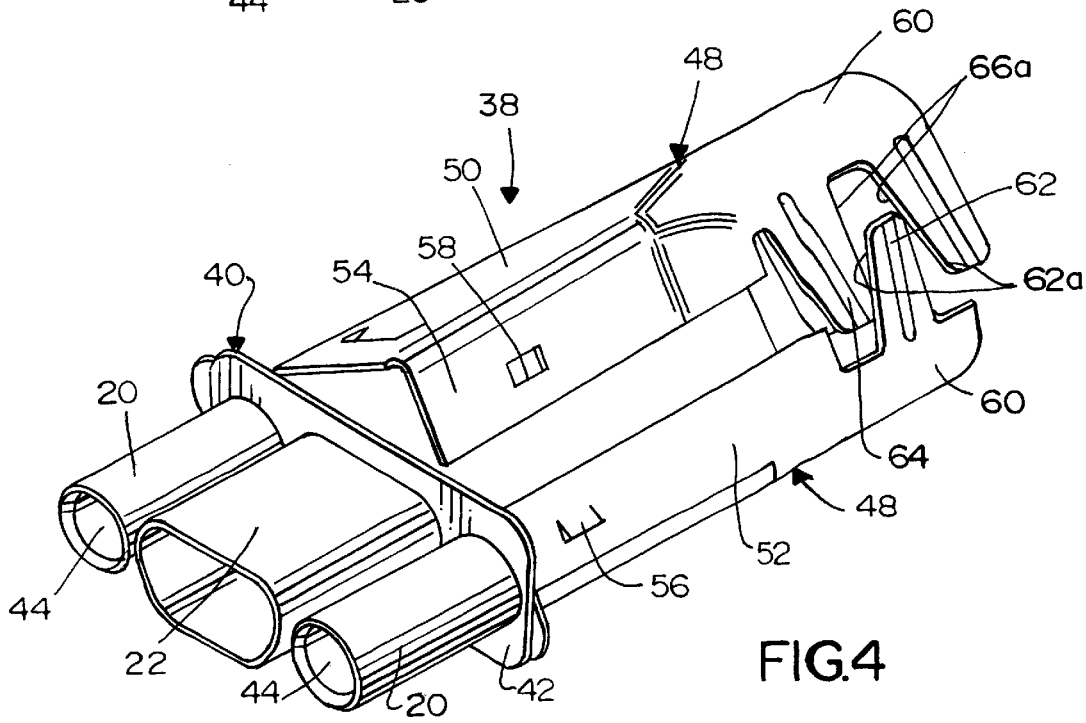
FIG. 4 is a perspective view similar to that of FIG. 3, but with the backshells in partially closed condition.
Figure 5:
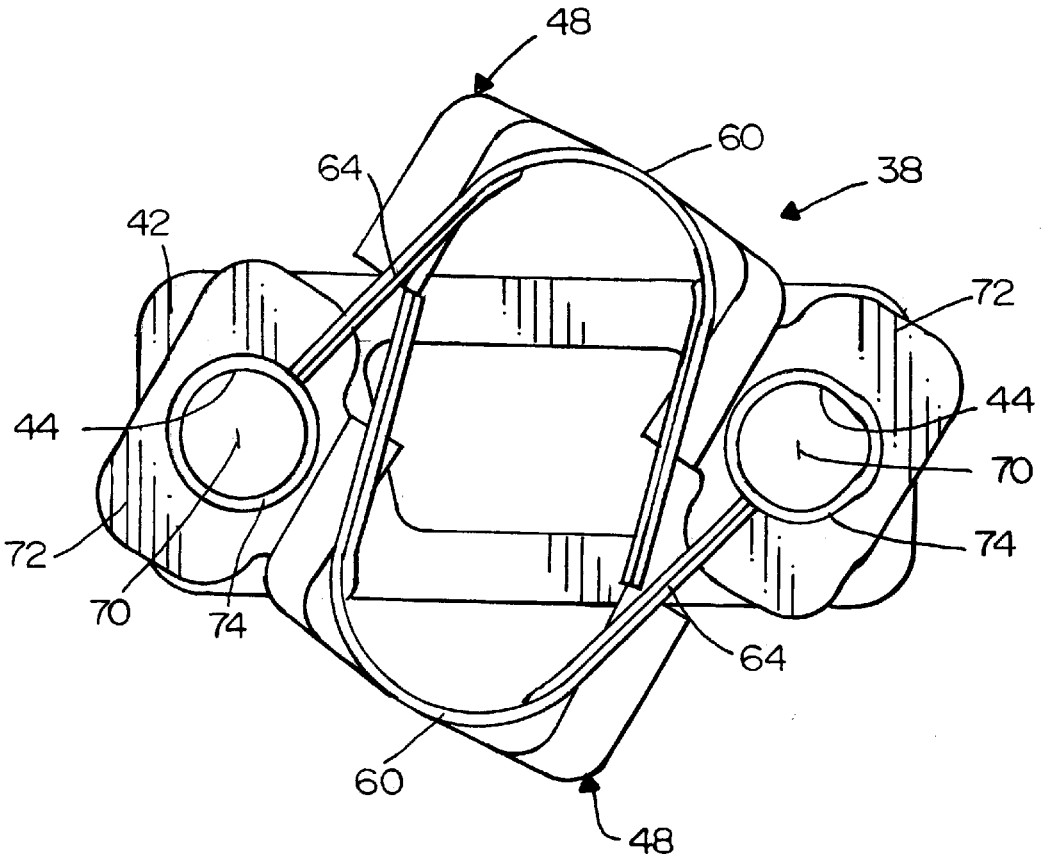
FIG. 5 is a rear elevational view of the shell assembly, looking toward the right-hand end of FIG. 4.
Figure 6:
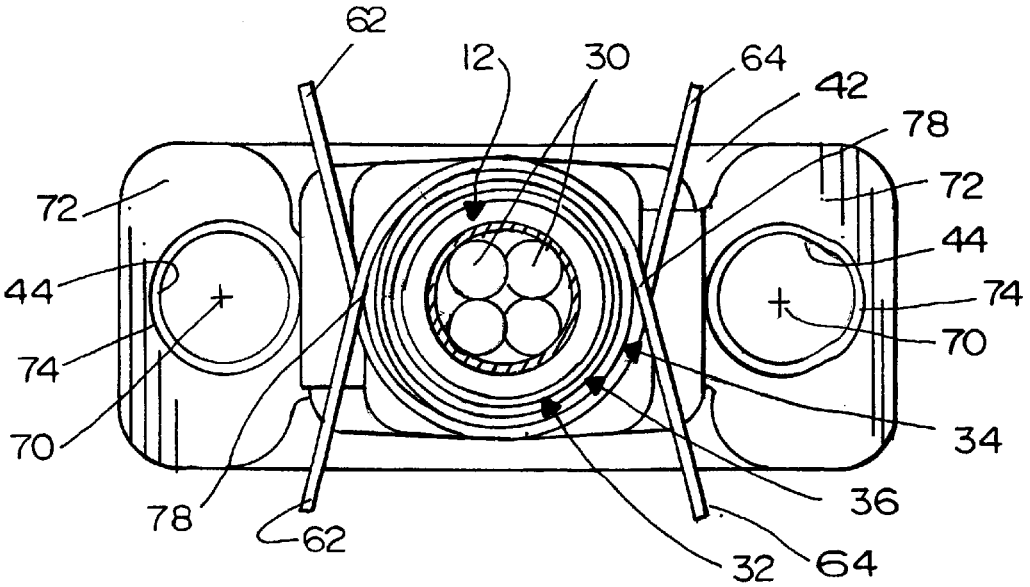
FIG. 6 is a rear elevational view of the shell assembly, with the backshells in closed position about the cable.
Figure 7:
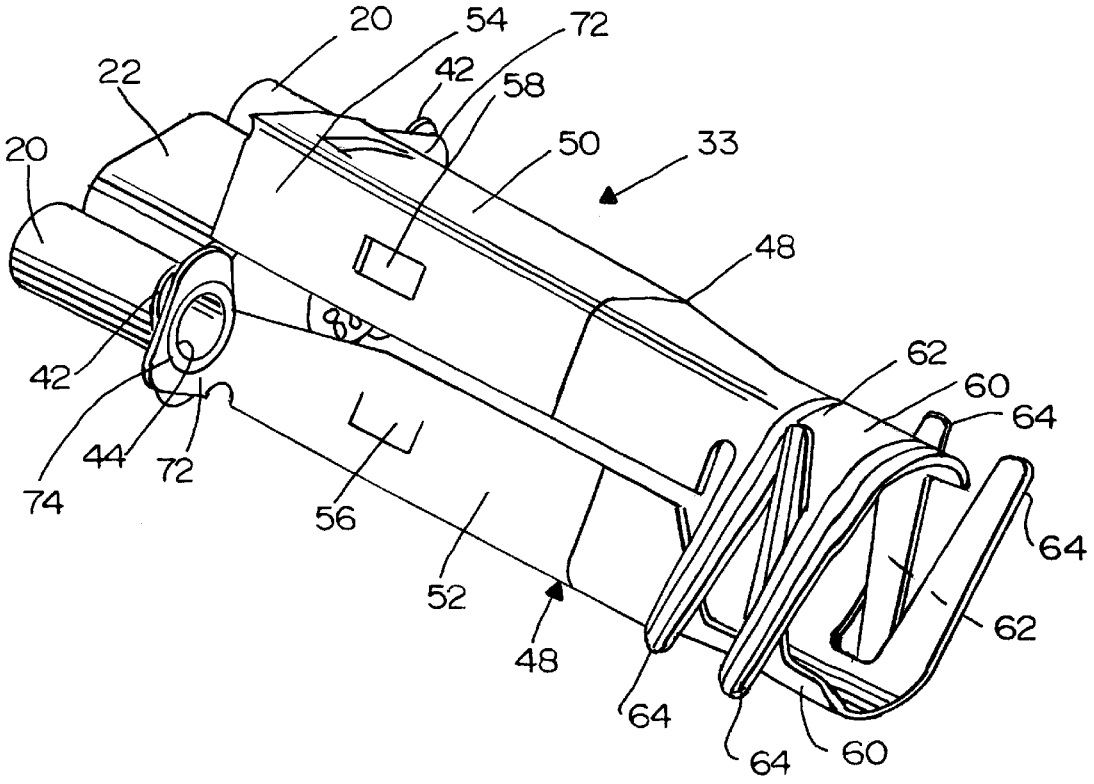
FIG. 7 is a rear perspective view of the shell assembly in partially closed position.
Figure 8:
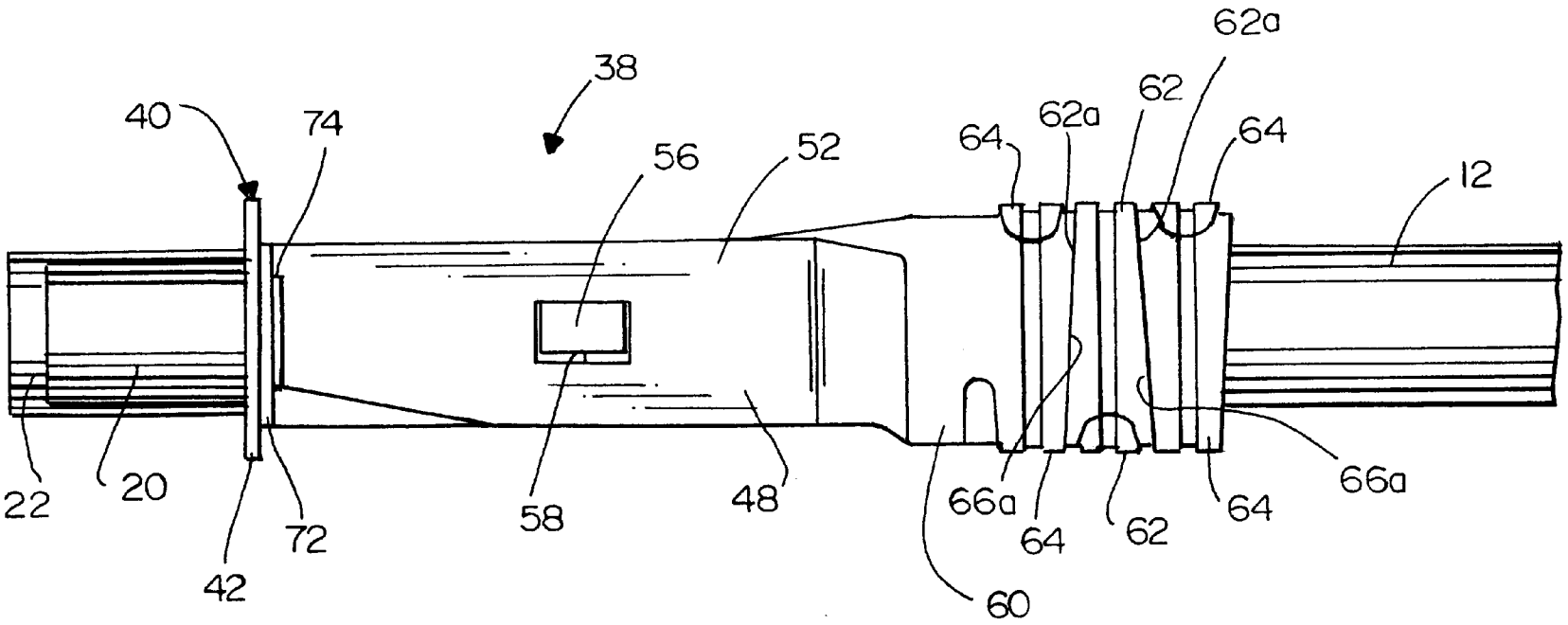
FIG. 8 is a side elevation view of the cable assembly with the shell assembly crimped to the cable.

The backshells 48 are swivelably mounted to the back side of plate 42 from fully open positions shown in FIG. 3, through partially closed positions shown in FIGS. 4, 5 and 7, to fully closed positions shown in FIGS. 6 and 8. The backshells swivel about front-to-rear axes 70 (FIG. 5) which form the centerlines of bushings 20. To facilitate this swiveling action, each backshell has a flange 72 (FIGS. 5 and 7) which is juxtaposed against the rear side of plate 42. Bushings 22 are of metal material and extend through appropriate aligned apertures in plate 42 and flanges 72, and the rear ends 74 (FIG. 5) of the bushings are flared outwardly over flanges 72 in a riveting manner to fasten the backshells to plate 42 of front shell 40, with the backshells being capable of swiveling about axes 70. Alternate methods of fastening the backshells 48 to the plate 42 include utilizing a screw inside the bushing 20 secured through the hole 44 with a nut or a threaded protrusion extending from the bushing 20 through the hole 44 and secured with a nut.

FIG. 6 shows shell assembly 38 with backshells 48 in their completely closed condition, with crimp fingers 62 and 66 in a position around cable 12 prior to crimping. Crimp fingers 62 have been forced into slots 66 (FIG. 3) to crimping points 78 (FIG. 6) whereat the outside edges 62*a* of the fingers 62 will engage the inside edges 66*a* of the slot 66. FIG. 8 shows the shell assembly 38 with crimp fingers 62, 64 crimped around cable 12 to completely encapsulate the cable without any and/or minimal voids between the outside edges 62*a* of the fingers 62 and the inside edges 66*a* of the slots 66. When fully closed, latch bosses 56 (FIG. 3) on side walls 52 resiliently snap into latch apertures 58 in side walls 54 as the backshells are closed. Side walls 52 and 54 of the respective backshells completely overlap each other to prevent any EMI/RF leakage from within the backshells. With crimp fingers 60 and 64 configured as described above, leakage also is prevented from the rear of the backshell assembly. The housing/terminal/cable subassembly of FIG. 2 is very easily assembled within shell assembly 38 in the open condition shown in FIG. 3, because the individual backshells do not have to be held since they are mounted to front shell 40.

It will be understood that the invention may be embodied in other specific forms without departing from the spirit or central characteristics thereof. The present

I claim:

1. An electrical connector, comprising:

an insulative housing having a forward mating end, a rear terminating end and a plurality of terminal-receiving passages therethrough;

a plurality of terminals received in the passages;

a conductive front shell about a substantial portion of at least the forward mating end of the housing; and a pair of conductive rear backshells about a substantial portion of at least the rear terminating end of the housing, the backshells being swivelably mounted to the front shell on front-to-rear axes for movement between open and closed positions.

2. The electrical connector of claim 1 wherein said mating end of the housing comprises a forwardly projecting profiled portion, and the front shell includes a forwardly projecting profiled shroud about said profiled portion.

3. The electrical connector of claim 1 wherein said pair of backshells have identical configurations.

4. The electrical connector of claim 1 wherein said conductive front shell includes a plate extending transversely of said axes and to which the backshells are swivelably mounted.

5. The electrical connector of claim 4 wherein said backshells include flanges juxtaposed against said plate on said axes.

6. The electrical connector of claim 5 wherein said flanges include apertures aligned with complementary apertures in the plate for receiving therethrough appropriate fastening means for the connector.

7. The electrical connector of claim 6, including a pair of guide bushings projecting forwardly of the plate coincident with said apertures for guiding the fastening means therethrough.

8. The electrical connector of claim 7 wherein said guide bushings extend through the apertures in both the plate and the flanges of the backshells, and the bushings have outwardly flared rear ends to fasten the backshells to the shell and to define the swivel axes of the backshells.

9. The electrical connector of claim 1 wherein said backshells include rear ends having strain relief sections for encapsulating appropriate conductors terminated to the terminals in the housing.

10. The electrical connector of claim 9 where the strain relief section of at least one of the backshells includes a crimp finger having opposite outside edges that converge toward a distal end of the finger, the strain relief section of at least the other of the backshells includes a slot having opposed inside edges that diverge toward a mouth of the slot, and the finger and the slot being complementarily dimensioned such that when the finger is crimped into the slot, the outside edges of the finger will engage the inside edges of the slot at a given crimping point and, thereby, completely encapsulate the conductors without any voids between the finger and the slot.

11. The electrical connector of claim 10, including at least one finger and at least one slot in each of the strain relief sections of each of the backshells.

12. The electrical connector of claim 11 wherein said pair of backshells have identical configurations.

13. An electrical connector, comprising:

an insulative housing having a forward mating end, a rear terminating end and a plurality of terminal-receiving passages therethrough;

a plurality of terminals received in the passages;

a conductive front shell about a substantial portion of at least the forward mating end of the housing; and a pair of conductive rear backshells about a substantial portion of at least the rear terminating end of the housing, the backshells including rear ends having strain relief sections for encapsulating appropriate conductors terminated to the terminals in the housing, the strain relief sections of each of the pair of backshells being opposed to each other, the strain relief section of at least one of the backshells including a crimp finger having opposite outside edges that converge toward a distal end of the finger, the strain relief section of at least the other of the backshells including a slot having opposed inside edges that diverge toward a mouth of the slot, and the finger and the slot being complementarily dimensioned such that when the finger is crimped into the slot, the outside edges of the finger will engage the inside edges of the slot and, thereby, completely encapsulate the conductors with minimal voids between the finger and the slot.

14. The electrical connector of claim 13, including at least one finger and at least one slot in each of the strain relief sections of each of the backshells.

15. A conductive shell assembly for an electrical connector having a mating end and terminating end defining a front-to-rear axis therebetween, the shell assembly comprising:

a conductive front shell about a substantial portion of at least said mating end; and a pair of conductive rear backshells about a substantial portion of at least said terminating end, the backshells being swivelably mounted to the shell on axes generally parallel to said front-to-rear axis for movement between open and closed positions.

16. The conductive shell assembly of claim 15 wherein said pair of backshells have identical configurations.

17. The conductive shell assembly of claim 15 wherein said conductive front shell includes a plate extending transversely of said axes and to which the backshells are swivelably mounted.

18. The conductive shell assembly of claim 17 wherein said backshells include flanges juxtaposed against said plate on said axes.

19. The conductive shell assembly of claim 18 wherein said flanges include apertures aligned with complementary apertures in the plate for receiving therethrough appropriate fastening means for the connector.

20. The conductive shell assembly of claim 19, including a pair of guide bushings projecting forwardly of the plate coincident with said apertures for guiding the fastening means therethrough.

21. The conductive shell assembly of claim 20 wherein said guide bushings extend through the apertures in both the plate and the flanges of the backshells, and the bushings have outwardly flared rear ends to fasten the backshells to the shell and to define the swivel axes of the backshells.

22. The conductive shell assembly of claim 21 wherein said pair of backshells have identical configurations.

* * * * *